US005582296A

United States Patent [19]

Beauchamp et al.

[11] Patent Number: 5,582,296

[45] **Date of Patent: *Dec. 10, 1996**

[54] STACKABLE LOAD BEARING TRAY

[75] Inventors: Maurice Beauchamp, St-Damien; Michel Lanoue, Ste-Foy, both of Canada

[73] Assignee: IPL Inc., St-Damien Bellechasse, Canada

[ * ] Notice: The term of this patent shall not extend beyond the expiration date of Pat. No. 5,372,257.

[21] Appl. No.: 258,661

[22] Filed: Jun. 10, 1994

[51] Int. Cl.[6] ..... B65D 1/34; B65D 21/032; B65D 21/04

[52] U.S. Cl. ..... 206/503; 206/507; 206/509; 206/512; 206/557

[58] Field of Search ..... 206/503, 504, 206/505, 507, 509, 512, 557; 220/608

[56] References Cited

U.S. PATENT DOCUMENTS

| | | | |
|---|---|---|---|
| 3,425,594 | 2/1969 | Bridenstine | 206/507 |
| 3,675,815 | 7/1972 | Rehrig | 206/507 |
| 4,095,070 | 6/1978 | Stahl | 206/507 |
| 4,106,624 | 8/1978 | Thurman | 206/507 |
| 4,189,052 | 2/1980 | Carroll et al. | 206/507 |
| 5,318,182 | 6/1994 | Thorud et al. | 206/509 |
| 5,372,257 | 12/1994 | Beauchamp et al. | 206/504 |

*Primary Examiner*—Allan N. Shoap
*Assistant Examiner*—Niki M. Kopsidas
*Attorney, Agent, or Firm*—Cushman Darby & Cushman IP Group of Pillsbury Madison & Sutro LLP

[57] ABSTRACT

A stackable tray comprising a body formed of rigid plastics material and consisting of a bottom wall integrally formed with opposite side walls and opposite front and rear walls; the front wall, at least, defines an access area to allow removal of articles from the bottom wall when the tray is in a superposed stacked relationship with similarly constructed trays; the front wall has an upper edge defining an enclosed tubular section extending from side wall to side wall to reinforce the tray when in a stacked relationship with similarly constructed trays and to counteract sagging of the bottom wall due to weight of articles placed thereon.

8 Claims, 8 Drawing Sheets

STACKABLE LOAD BEARING TRAY

FIELD OF THE INVENTION

The present invention relates to a load bearing tray which is adapted to be stacked with similarly constructed trays which, when stacked, still allow one to have access to the load carried by anyone of the trays.

BACKGROUND OF THE INVENTION

At present, stackable trays are used for delivering to and displaying in stores bread loaves. These trays are formed of a body of rigid plastics material and consist of a bottom wall integrally formed with opposite side walls, a rear wall and a front wall, the latter providing an access area to the bread loaves. The structural configuration of the trays is such that, for a stacked arrangement, they are simply placed one on top of the other, the lower edge of the opposite side walls of a tray resting on the upper edge of the opposite side walls of the lower tray.

It has been found that, when the trays are loaded and a number of them are stacked, there is a downward sagging force exerted on the bottom wall, especially adjacent the access area of the front wall, thus causing an inward movement of the side walls, which movement is further increased as the number of loaded superposed trays becomes important. One solution used is to increase the thickness of the structure of the front wall while another is to include a metallic reinforcement in the front wall of the tray.

A first method of overcoming the above problems has been described in applicant's co-pending U.S application Ser. No. 08/230,375 filed Apr. 20, 1994. Its disclosure describes a stackable tray which is formed of a body of rigid plastic material with a bottom wall integrally formed with opposite side walls and front and rear walls; each side wall is provided with an upper edge flange which is engageable in a recessed area defined in the lower edge of a superposed similarly constructed tray. The location of the recessed area with respect to the upper edge flange is such as to force outwardly the side walls during stacking engagement, thus causing internal stresses in the bottom wall which counteract the sagging which occurs when loads are supported on the bottom wall.

STATEMENT OF THE INVENTION

It has been found that the problems with existing trays, may be further overcome, especially in case of bread trays where it may be desired to have access through both sides of the trays, by constructing the top edge of each wall having an access area with an enclosed tubular section. This greatly reinforces the structure of the wall having such access area and reduces sagging of the bottom wall due to the weight of the articles supported thereon.

The present invention therefore relates to a stackable tray which comprises a body formed of a rigid plastics material and consisting of a bottom wall integrally formed with opposite side walls and opposite front and rear walls; at least the front wall defines an access area to allow removal of articles, such as bread loaves, from the bottom wall when the tray is in superposed stacked relationship with similarly constructed trays. Each side wall defines an upper edge and a lower edge shaped to engage lower and upper edges of similarly constructed stacked trays. The front wall has an upper edge defining an enclosed tubular section extending from side wall to side wall to reinforce the tray when in a stacked relationship with similarly constructed trays to counteract sagging of the bottom wall due to the weight of articles placed thereon.

In one form of the invention, each side wall includes an enclosed tubular section in an area adjacent the opposite ends of the front wall.

In another form of the invention, the rear wall also includes an access area and defines an enclosed tubular section extending side wall to side wall as the front wall.

In another form of the invention, each side wall further includes an enclosed tubular section in an area adjacent the opposite ends of the rear wall.

In a preferred form of the invention, all the above enclosed tubular sections define gas-assisted injection molded chambers.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

Figure 1:
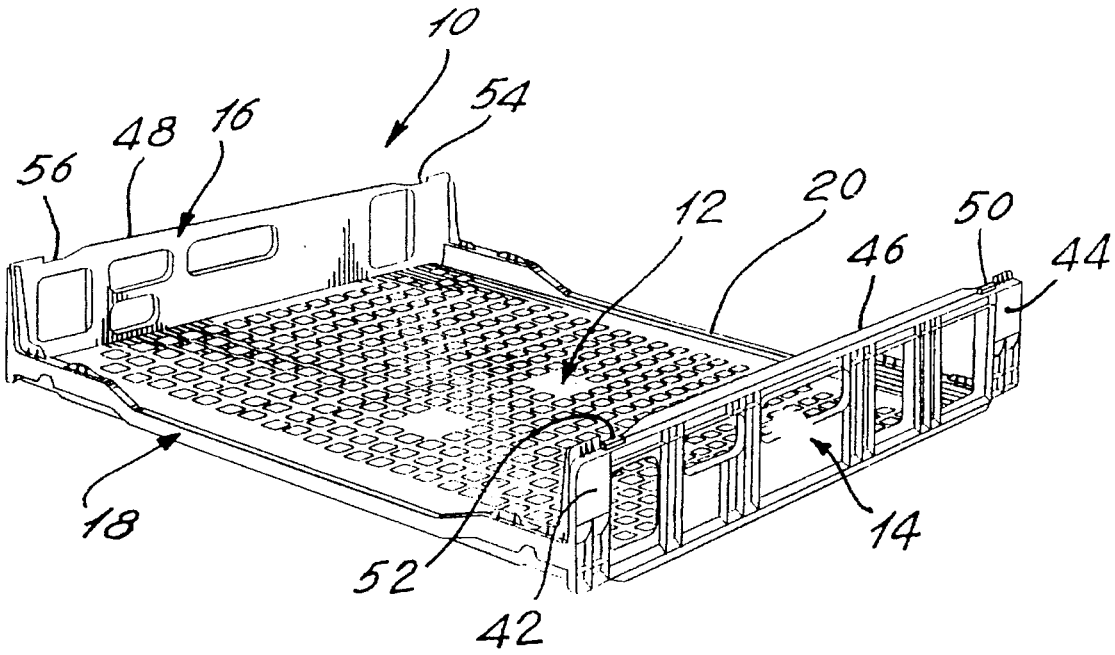
FIG. 1 is a front perspective view a tray made in accordance with the present invention.

Referring to FIG. 1, there is shown a stackable tray, generally denoted 10, constructed in accordance with the present invention and having a body formed of a rigid plastics material, such as a high density polyethylene, and consisting of a bottom wall 12 integral with opposite side walls 14 and 16, front wall 18 and rear wall 20.

Figure 2:
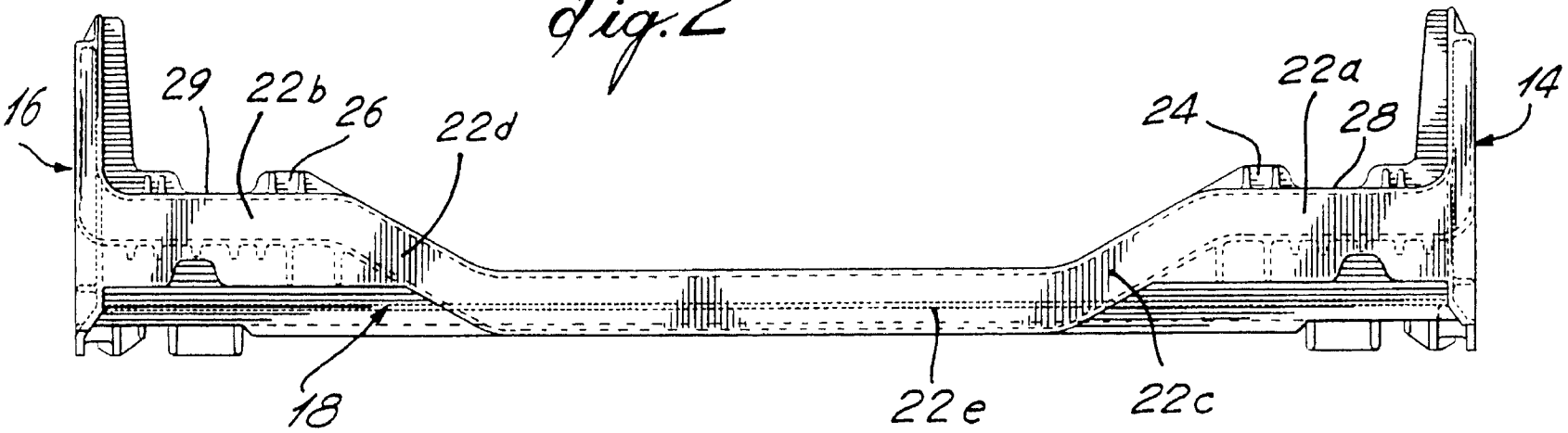
FIG. 2 is a front elevation thereof.

Referring to FIG. 2, the front wall 18 displays an upper edge including a pair of horizontal side sections **22*a* and 22*b*, adjacent to side walls 14 and 16 respectively, and a pair of inclined sections 22***c* and 22*d* sloping down to a lower horizontal central section 22*e*. Sections 22*c*, 22*d* and 22*e* define an access area on the front wall allowing one to place or retrieve articles on and from the bottom wall 12. Sections 22*a* and 22*b* display upwardly extending flanges 24 and 26, respectively, each including a recess at 28 and 29.

Figure 3:
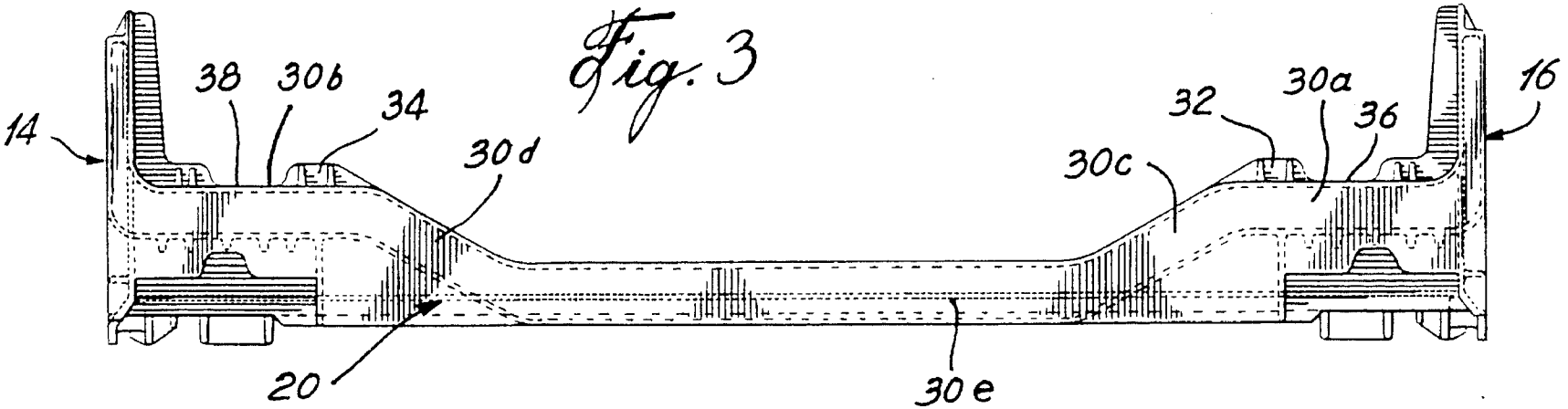
FIG. 3 is a rear elevation thereof.

Referring to FIG. 3, the rear wall 20 displays an upper edge including a pair of horizontal side sections 30*a* and 30*b*, adjacent to the side walls 16 and 14 respectively, and a pair of inclined sections 30*c* and 30*d* sloping down to a lower horizontal central section 30*e*. Sections 30*c*, 30*d* and 30*e* define a second access area on the rear wall allowing one to place or retrieve articles from either side of stacked trays. Sections 30*a* and 30*b* display upwardly extending flanges 32 and 34, respectively, each including a recess at 36 and 38.

Figure 4:
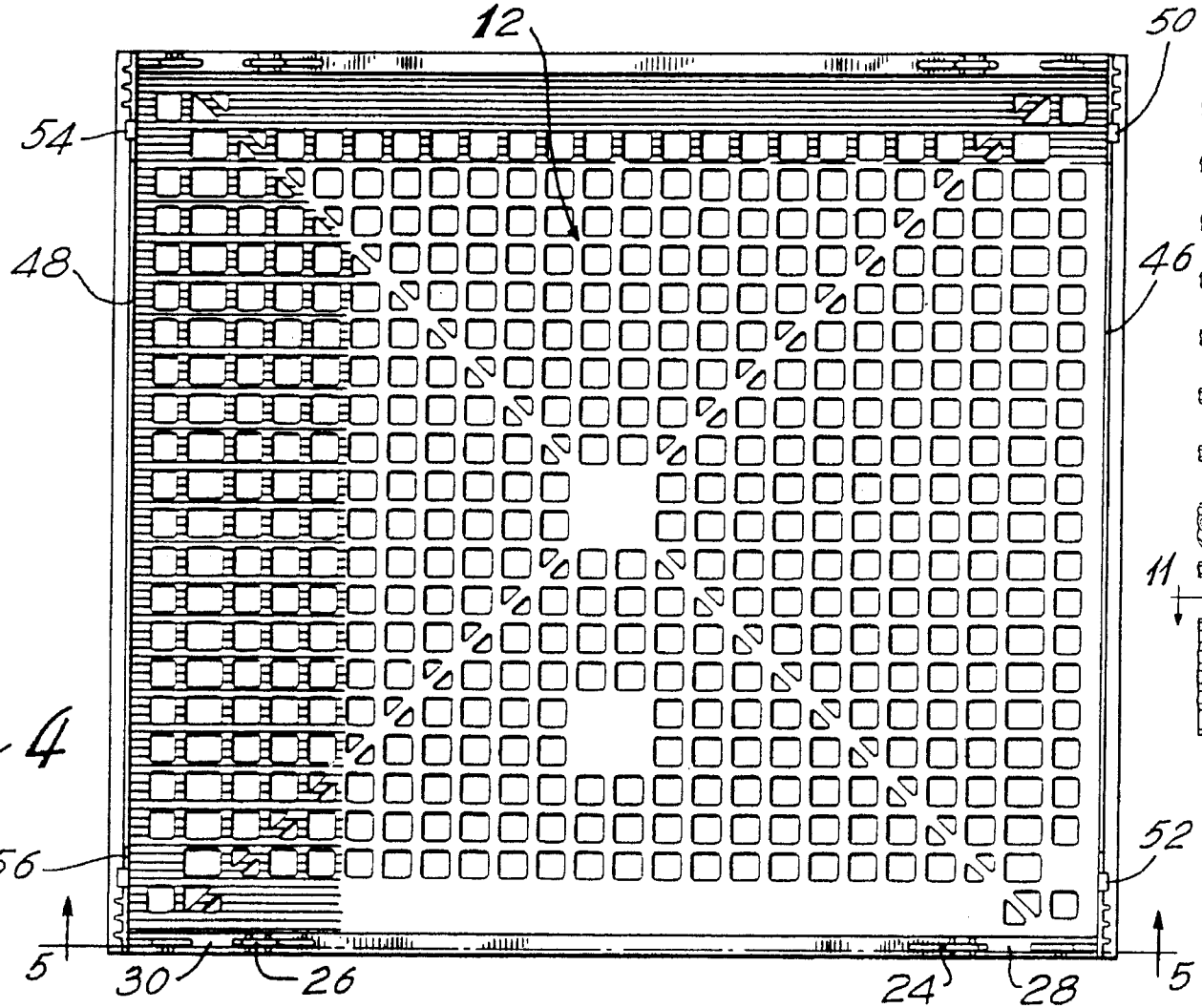
FIG. 4 is a top plan view thereof.

Referring to FIG. 4, the bottom wall 12 displays a flat upper face that includes a series of rectangular and triangular openings providing lightness to the tray.

Figure 5:
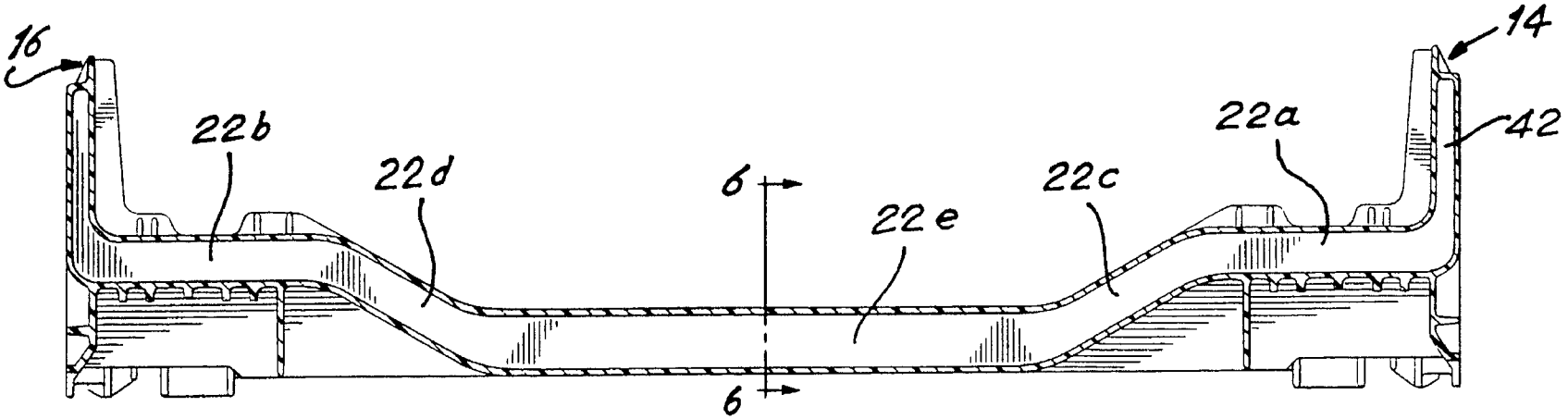
FIG. 5 is a cross-sectional view taken along lines 5—5 of FIG. 4.
Figure 6:
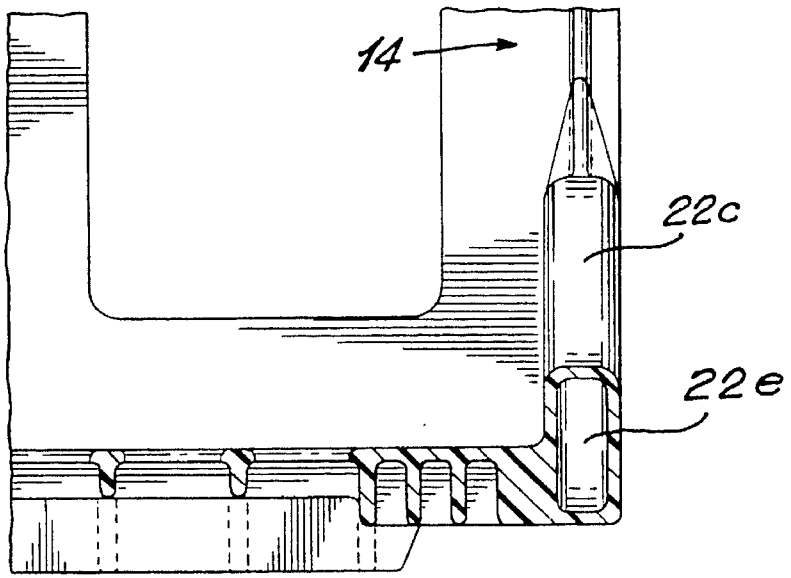
FIG. 6 is a cross-sectional view taken along lines 6—6 of FIG. 5.
Figure 8:
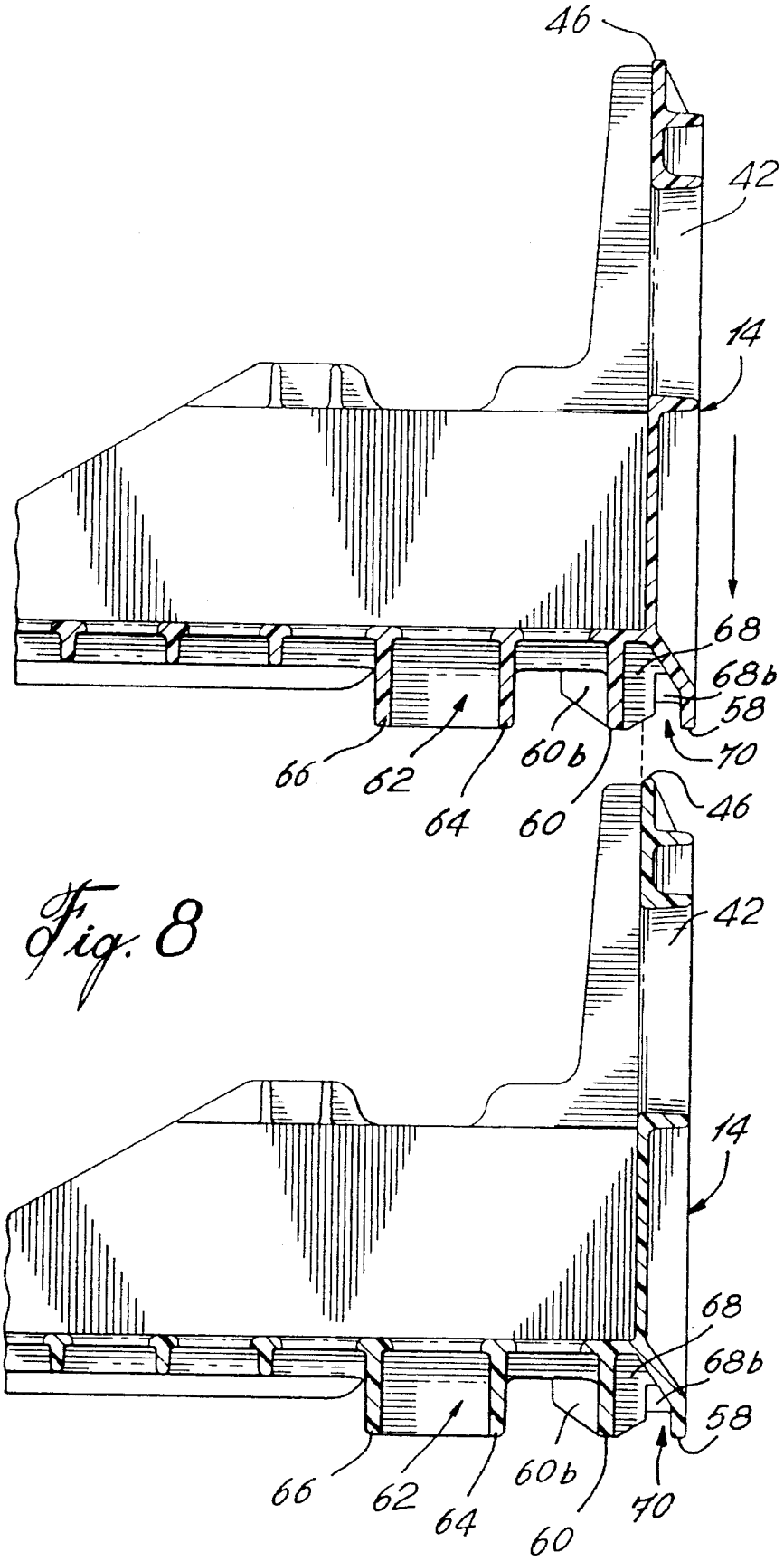
FIG. 8 is an enlarged cross-sectional fragmental view showing two superposed trays prior to stacking.

To reinforce the front wall and the rear wall in order to prevent sagging of the bottom wall, the tubular sections 22*a*, 22*b*, 22*c*, 22*d*, 22*e* as well as tubular sections 30*a*, 30*b*, 30*c*, 30*d*, 30*e* are enclosed hollow chambers which are formed, preferably, by a gas-assisted injection molded procedure well known in the injection molding trade (see FIGS. 5 and 6). For example, such methods are described in U.S. Pat. Nos. 4,948,547, 5,028,377 and 5,110,533, all granted to J. W. Hendry.

Referring also to FIG. 1, each side wall 14, 16 displays a series of openings, also to provide lightness to the tray; two of these openings, disposed centrally of each side wall, serve as handles for carrying the tray. The opposite ends of each side wall 14, 16 include an enclosed chamber (see 42 and 44 for side wall 14) which is preferably in communication with their tubular sections 22*a*, 22*b*, 30*a* and 30*b* of the front and rear walls 18, 20, to give increased rigidity to the side walls. These chambers are also formed by gas-assisted injection molding. The side walls 14 and 16 also include an upper projecting flange 46 and 48, each displaying two recesses 50, 52, and 54, 56.

Figure 7:
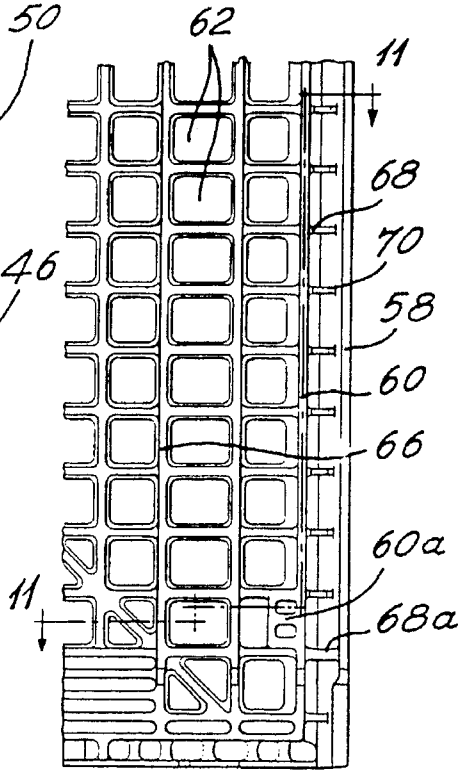
FIG. 7 is an enlarged fragmental bottom view of one corner of the tray and is shown on the sheet illustrating FIG. 4.

FIG. 7 shows a bottom view of one corner of the tray; however, all four corners of the tray are of an identical construction. The lower edge of each side wall comprises an outer longitudinal flange 58 parallel to an inner longitudinal flange 60. A longitudinal arrangement of rectangular openings 62 formed by side walls 64 and 66 is disposed inwardly of flange 60. The lower edge of flanges 58, 60, 64 and 66 is lower than that of the remaining face of the bottom wall. Integral with flange 60 is a series of longitudinally spaced ribs 68 thus leaving a gap or recessed area 70 between the vertical edge of the ribs and the outer flange 58. The ribs 68*a* and 68*b* at opposite ends, adjacent of the front and rear walls, extend the full width of the area separating flanges 58 and 60. Also, at each opposite end of flange 60, adjacent the front and rear walls, are blocks 60*a* and 60*b* which have a sloping lower face, the function of which will be described further hereinbelow. Similarly, ribs 68 have a sloping lower edge, the function of which will be described further hereinbelow.

Figure 9:
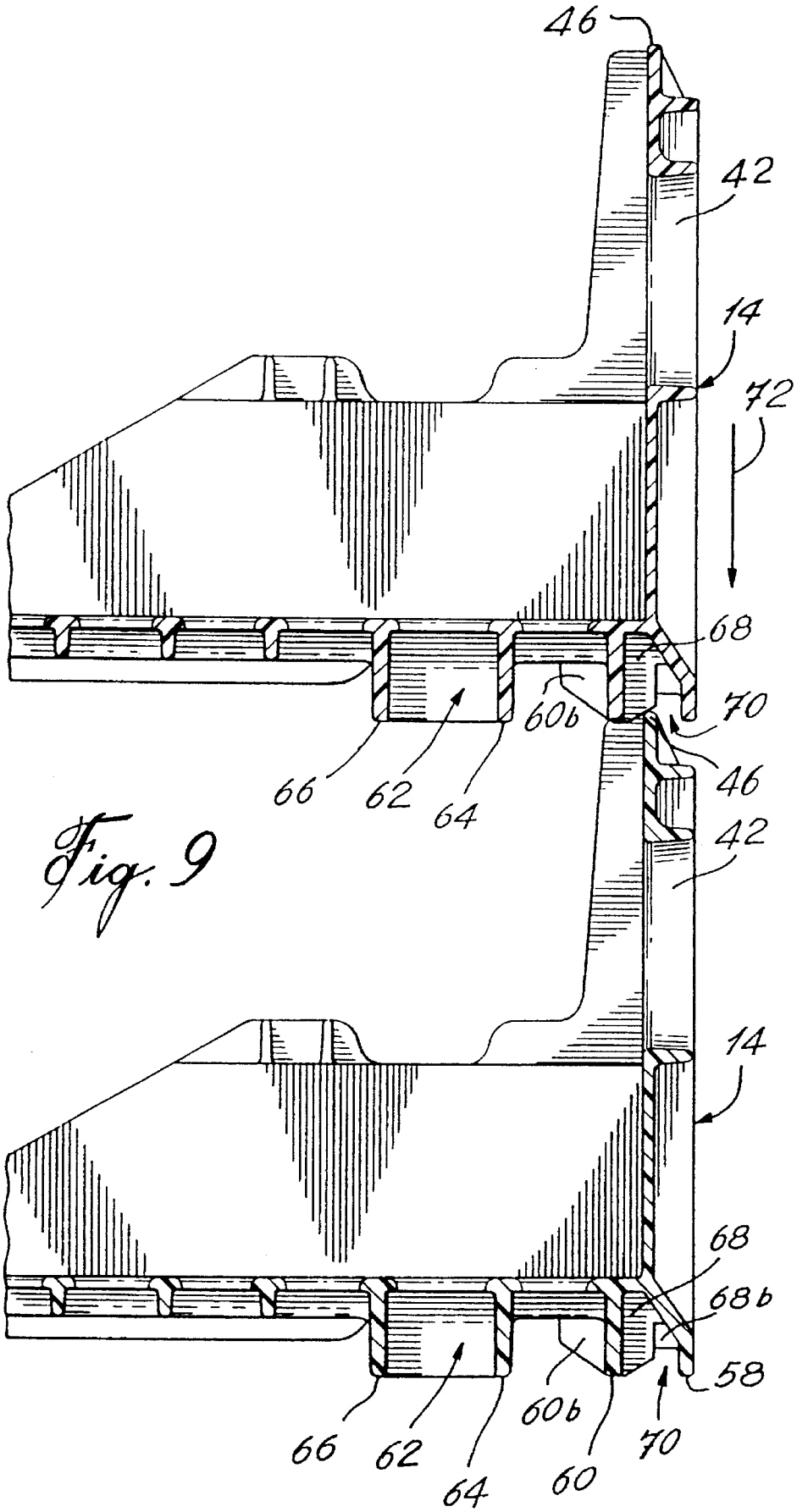
FIG. 9 is an enlarged cross-sectional view similar to that of FIG. 8 showing the trays in contact prior to engagement with one another.
Figures 10, 11:
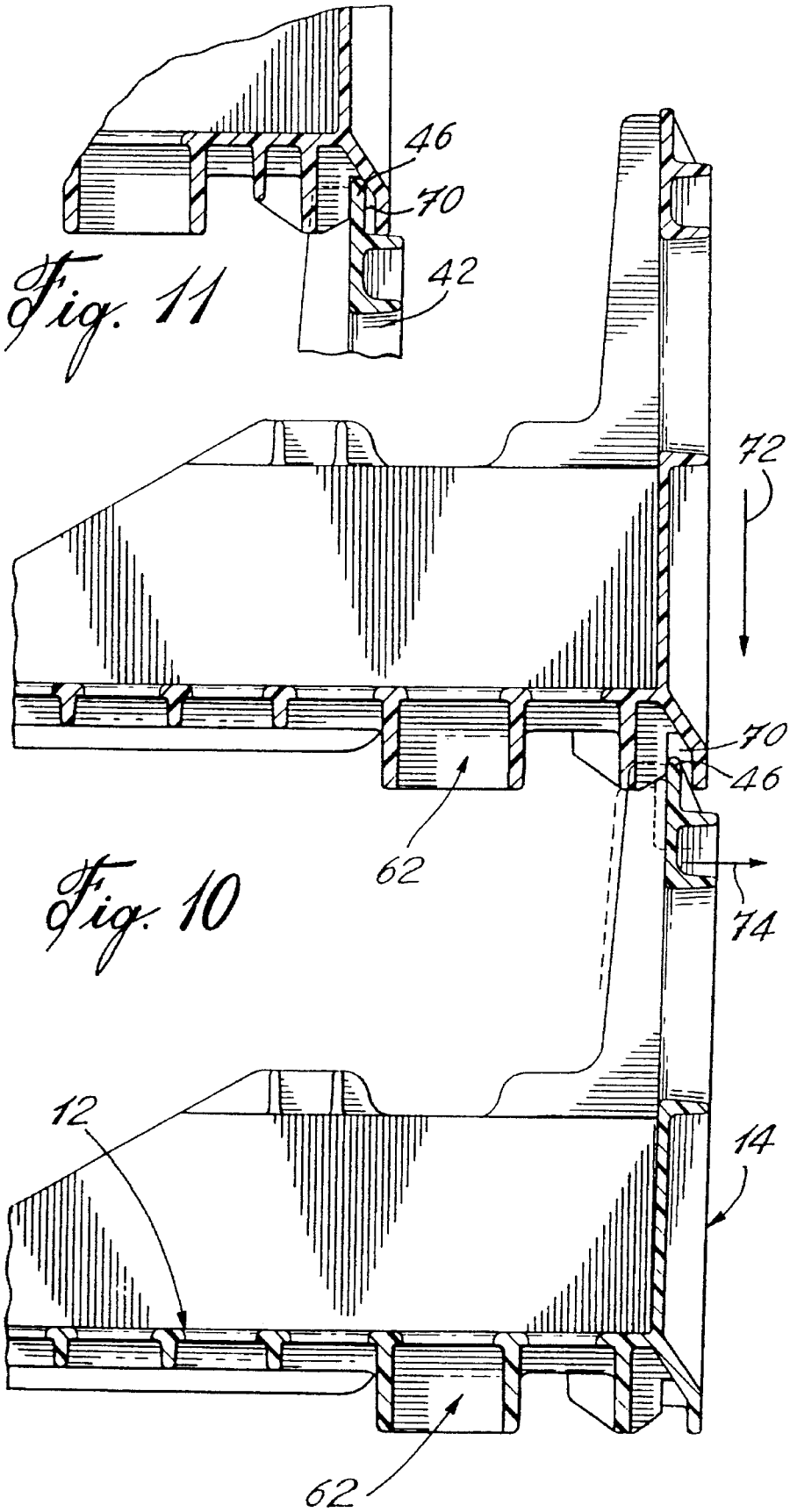
FIG. 10 is an enlarged cross-sectional view similar to that of FIG. 8 showing the trays during engagement.
FIG. 11 is an enlarged cross-sectional view taken along lines 11—11 of FIG. 7 and showing parts of two trays in full engagement.
Figure 13:
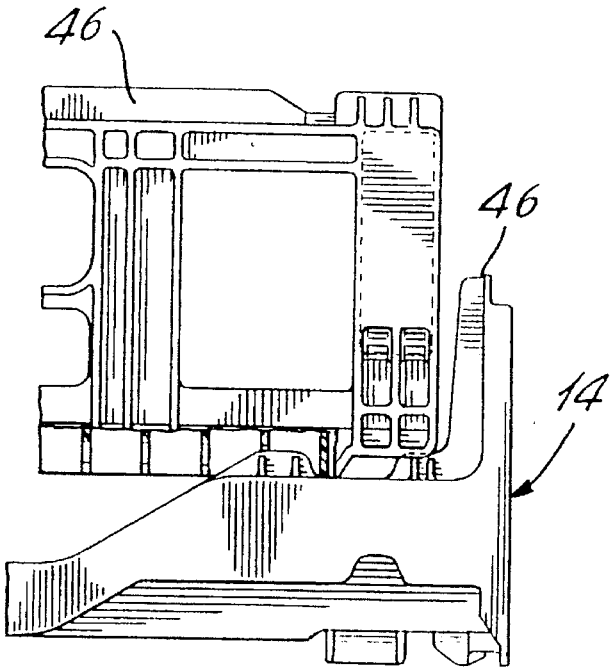
FIG. 13 is a fragmental front elevation showing two trays in a nested arrangement.

Referring to FIGS. 8, 9, 10 and 11, the nesting steps of two superposed trays are illustrated. As can be seen in FIG. 9, first contact between the two trays occurs when the upper flange 46 of the lower tray contacts the sloping edge of ribs 68 in the area indicated by arrow 72. In FIG. 10, as the upper tray is further lowered, as indicated by arrow 72, the side wall 14 of the lower tray is caused to move outwardly, as indicated by arrow 74, as a result of the upper flange 46 being forced into the recessed area 70. This outward movement of side walls 14 and 16 causes upward bending forces in the bottom wall 12 of the tray. Finally, in the position shown in FIG. 11, the two trays are shown fixed by secured with the upper flange 46 being entirely received within the area 70. The resiliency of the plastics material of the tray tends to return the side walls to their vertical position thus increasing frictional contact between the parts and securing the nesting engagement of the trays.

Figure 12:
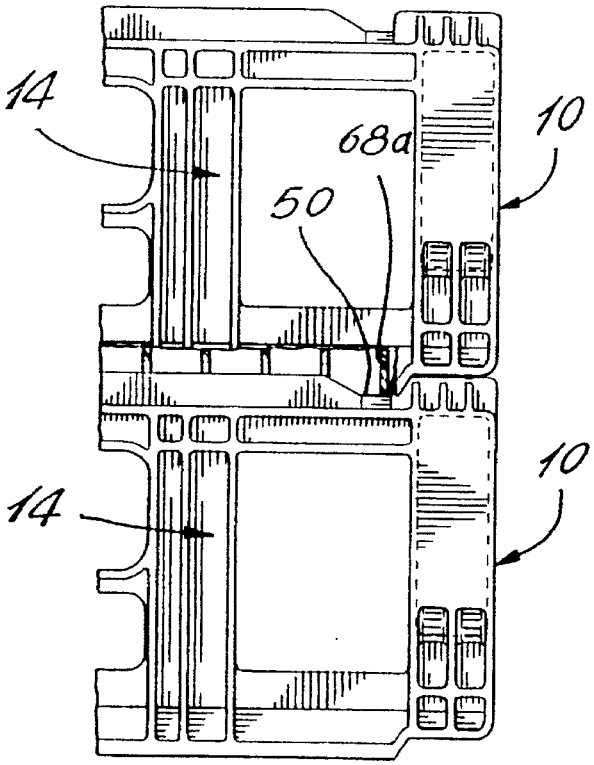
FIG. 12 is a fragmental side elevation showing two trays in a stacked condition.

Referring to FIG. 12, the stacked trays are prevented to move relative to one another in a direction parallel to the side walls as a result of the ribs 68*a* and 68*b* engaging their corresponding recesses 50 and 52 in the upper flange 46. Similar engagement is achieved in the opposite side wall 16 of the tray.

The tray is preferably rectangular with the front end rear walls being wider than the side walls so that, when the trays are not used for displaying articles, such as bread loaves, they may be nested in one another such as illustrated in FIG. 11 with the front and rear walls of a tray being received adjacent and parallel to the side walls of a lower tray. The nesting is facilitated by the upper flanges 24, 26 of the front wall and 36 of the rear wall sliding along the sloping lower faces of blocks 60*a*and 60*b* to thereafter slide into the area between the blocks and the vertical flange 64.

Although the invention has been described above in relation to a specific form, it will be evident to the man skilled in the art that it may be modified and refined in various ways. For example, the rear wall may be without an access area as shown in the drawings in cases where an enclosed tubular section on the front wall may be sufficient to prevent sagging. It is therefore wished to have it understood that the invention should not be limited in interpretation, except by the terms of the following claims.

The embodiments of the invention in which an exclusive property or privilege is claimed are defined as follows:

1. A stackable tray comprising a body formed of rigid plastics material and comprising a bottom wall integrally formed with opposite side walls and opposite front and rear walls, at least said front wall defining an access area to allow removal of articles from said bottom wall when said tray is in a superposed, stacked relationship with identically constructed trays; each said side wall having an upper edge and a lower edge shaped to engage lower and upper edges of identically constructed trays in said stacked relationship; said front wall having an upper edge defining an enclosed tubular section extending from side wall to side wall to reinforce said tray when in said stacked relationship with identically constructed trays and to counteract sagging of said bottom wall due to weight of articles placed thereon, each said enclosed tubular section defining a gas-assisted injection molded chamber, said lower edge of each side wall defining a recessed area to receive therein the upper edge of each side wall of an identically constructed tray therebeneath; said recessed area, prior to a stacking engagement, extending in a plane slightly offset outwardly relative to a plane including said upper edge whereby, during stacking, said upper edge forcibly engages in said recessed area causing an outward movement of said wall to further counteract sagging of said bottom wall due to the weight of articles placed thereon.

2. A stackable tray as defined in claim 1, wherein said recessed area of said lower edge includes a series of ribs displaying a lower sloping edge which is contacted by said upper edge of a lower disposed tray prior to be forcingly engaged in said recess.

3. A stackable tray as defined in claim 2, wherein said recessed area displays, at opposite ends thereof adjacent said front and rear walls, a transverse rib; said upper edge displaying, at opposite ends thereof adjacent said front and rear walls, a recess into which the transverse ribs of a superposed similarly constructed tray are received during stacking.

4. A stackable tray as defined in claim 1, wherein the height of each said side wall is greater than the height of said front and rear walls and wherein the distance between said side walls is greater than the distance between said front and rear walls whereby the trays are nestable with each successive tray when disposed at 90° relative to one another.

5. A stackable tray as defined in claim 4, wherein said front and rear walls display an upwardly extending flange, each flange including, at opposite ends thereof adjacent said side walls, a recess; and wherein said bottom wall includes, adjacent said recess at said lower edge of said side walls, a further recess receiving therein said flanges of said front and rear walls during nesting.

6. A stackable tray as defined in claim 5, wherein each said further recess includes, at opposite ends thereof adjacent said front and rear walls, a block having a sloping face to assist in the nesting of trays.

7. A stackable tray as defined in claim 1, wherein each said side wall includes a series of openings; one of said openings being centrally located and serving as a handle for carrying said tray.

8. A stackable tray as defined in claim 1, wherein said rigid plastics material is a high density polyethylene.

* * * * *